US008123554B2

(12) United States Patent
Leipold et al.

(10) Patent No.: US 8,123,554 B2
(45) Date of Patent: Feb. 28, 2012

(54) COAXIAL PLUG-CONNECTOR PART WITH BALL

(75) Inventors: Markus Leipold, Isen (DE); Werner Perndl, Vaterstetten (DE)

(73) Assignee: Rohde & Schwarz GmbH & Co. KG, München (DE)

( * ) Notice: Subject to any disclaimer, the term of this patent is extended or adjusted under 35 U.S.C. 154(b) by 101 days.

(21) Appl. No.: 12/672,488

(22) PCT Filed: Mar. 13, 2009

(86) PCT No.: PCT/EP2009/001844

§ 371 (c)(1),
(2), (4) Date: Feb. 17, 2010

(87) PCT Pub. No.: WO2009/127304

PCT Pub. Date: Oct. 22, 2009

(65) Prior Publication Data

US 2011/0097929 A1 Apr. 28, 2011

(30) Foreign Application Priority Data

Apr. 15, 2008 (DE) ..... 10 2008 018 809

(51) Int. Cl.
*H01R 9/05* (2006.01)

(52) U.S. Cl. ..... 439/578; 439/17

(58) Field of Classification Search ..... 439/17, 439/578

See application file for complete search history.

(56) References Cited

U.S. PATENT DOCUMENTS

| | | | | |
|---|---|---|---|---|
| 2,641,744 | A | 6/1953 | Packh et al. | 439/18 |
| 2006/0043809 | A1 | 3/2006 | Lau et al. | 310/91 |

FOREIGN PATENT DOCUMENTS

| | | |
|---|---|---|
| DE | 1 818 144 U | 9/1960 |
| EP | 0 327 204 | 8/1989 |
| EP | 0 951 110 | 10/1999 |
| EP | 0 955 701 | 11/1999 |
| GB | 2 053 590 | 2/1981 |

*Primary Examiner* — Tho D Ta

(74) *Attorney, Agent, or Firm* — Marshall, Gerstein & Borun LLP

(57) ABSTRACT

In a coaxial plug-connector part with a cap nut arranged in a rotatable manner on an outer conductor of a coaxial line system and with a ball bearing between cap nut and outer conductor, the ball bearing cooperates with a bearing bush. The ball bearing and the bearing bush are held within the cap nut by a bearing cover screw-connected to the cap nut, and this enclosed structural group can be fitted, via a continuous internal borehole of the bearing bush, onto the outer conductor of the coaxial line system to be connected.

8 Claims, 2 Drawing Sheets

COAXIAL PLUG-CONNECTOR PART WITH BALL

BACKGROUND OF THE INVENTION

1. Field of the Invention

The invention relates to a coaxial plug-connector part with a cap nut, arranged in a rotatable manner on an outer conductor of a coaxial line system.

2. Related Technology

Current, commercially available coaxial plug-connectors, designated as N-, 1 mm-, 2.92 mm-, SMA-, 1.85 mm-, 3.5 mm- or 2.4 mm-plugs, or respectively as so-called Zwitter plugs with the designation PC7, are all structured according to this principle with a cap nut screw-connected to the outer conductor, wherein the cap nut can, in many cases, also be provided on the bush component.

An arrangement of a ball bearing to reduce the friction between cap nut and outer conductor is known from EP 0 327 204 B1.

SUMMARY OF THE INVENTION

The invention provides a reliable and durable plug-connector part, which can be fitted as an independent structural group at the contact end of any required coaxial power line systems.

Accordingly, the invention provides a coaxial plug-connector part with a cap nut, arranged in a rotatable manner on an outer conductor of a coaxial line system, which can be screw-connected to an outer thread of a counter plug-connector part, wherein at least one roller bearing is arranged between the cap nut and the outer conductor, characterized in that the roller bearing cooperates with a bearing bush and is held together with the bearing bush within the cap nut by a bearing cover screw-connected to the cap nut, wherein the enclosed structural group can be fitted via a continuous internal borehole of the bearing bush onto the outer conductor of the coaxial line system to be connected.

According to the invention, the coaxial plug-connector part provides the advantage that it can be prefabricated as an independent, testable structural group; in service, it can be very easily dismantled from the coaxial line system; and, as an enclosed, self-contained structural group in which all structural elements are pre-assembled within the cap nut, it can be fitted to the contact ends of any required coaxial line systems, such as coaxial cables, rigid coaxial line ends on devices or test probes.

BRIEF DESCRIPTION OF THE DRAWINGS

Exemplary embodiments of the invention are described in greater detail below with reference to the drawings. The drawings are as follows.

DETAILED DESCRIPTION

Figure 1:
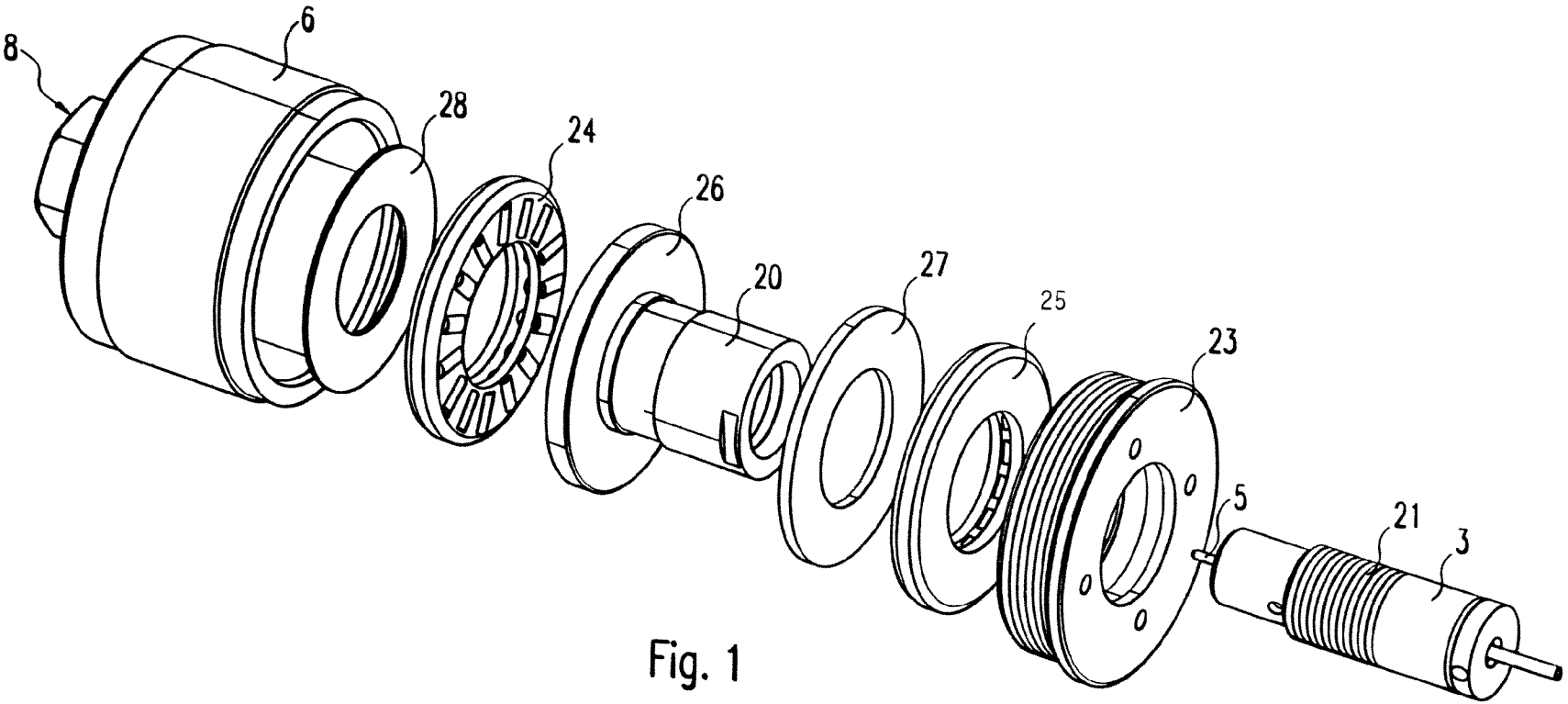
FIG. 1 shows the individual parts of a coaxial plug-connector part in a considerably enlarged scale in an exploded diagram.

The coaxial plug-connector according to the invention consists of a plug component 1 and a bush component 2. The plug 1 consists of an outer conductor 3, in which the internal conductor 5 is arranged via a supporting washer in a coaxial manner. The coaxial line 3, 5 continues at the rear side of the plug 1, for example, within a device or within a coaxial cable. A cap nut 6, which is attached to the outer conductor 3 by a force-fit connection, is fitted in a rotatable manner to the outer conductor 3. To establish the coaxial connection, the internal thread 8 of the cap nut 6 must be screwed onto the outer thread 9 of the bush 2 until the annular end-face contact surface 10 of the outer conductor 3 of the plug 1 contacts the corresponding annular end-face contact surface 11 of the bush 2. In this context, the tip 12 of the internal conductor 5 is pushed into the radially-sprung, sleeve-shaped bush 13 of the bush component 2.

In the exemplary embodiment illustrated, the cap nut 6 is arranged no longer in a directly rotatable and axial, force-fit manner on the outer conductor 3 of the coaxial line system, but on a bearing bush 20, which, like the cap nut 6, is preferably made of stainless steel. This bearing bush 20 provides a continuous internal borehole, into which the end of the coaxial line system to be connected can be inserted and, for example, screwed via an external thread 21 formed on the outer conductor 3 of the coaxial line system into an internal thread 22 of this continuous borehole of the bearing bush. A bearing cover 23 can be screwed into the open end of the pot-shaped cap nut 6.

In the exemplary embodiment, the roller bearings provided to reduce the frictional torque of the axial, force-fit connection between the cap nut 6 and the bearing bush 20 are designed as needle bearings 24 and 25. They are fitted at both sides of the annular flange 26 formed on the bearing bush 20 on corresponding cylindrical portions of the bearing bush 20. As indicated by the running discs 27 in FIG. 1, additional running washers can optionally be arranged between the needle bearings 24 and respectively 25 and the end-face surfaces of the annular flange 26, on which the needle bearings roll.

Figure 2:
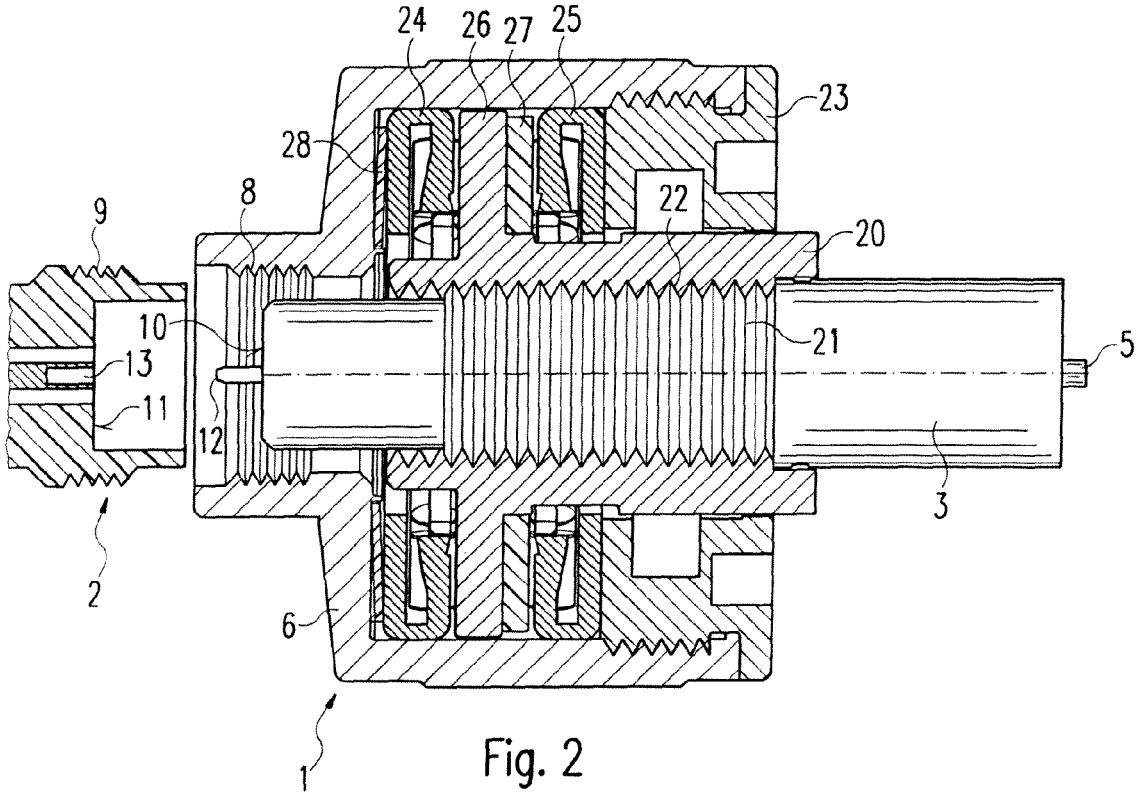
FIG. 2 shows the section through a coaxial plug-connector part assembled from the individual parts according to FIG. 1 fitted onto the end of a coaxial line system.

To ensure that no play occurs between the co-operating components even with a released connection, another plate spring 28 is preferably provided between the base of the cap nut 6 and the first axial bearing 24 following it. In the assembled condition as shown in FIG. 2, the cap nut 6 connected to the cover 23 forms, together with the bearing bush 20 arranged in the interior of the cap nut and the axial bearings 24, 25 cooperating with the latter, an enclosed component group, which can be prefabricated independently and which is screwed onto the end of the coaxial line system 3, 5 only directly upon use. This enclosed component group can be fitted onto the outer conductor 3 of the coaxial line system from the front, which also considerably facilitates the assembly. In service, the component group can also very easily be dismantled from the coaxial line system and replaced by a new component group if required.

The cap nut 6 and the bearing bush 20 preferably consist of a high-strength metallic material such as stainless steel. Accordingly, there is also a direct thermal contact between the outer surface of the cap nut and the outer conductor of the coaxial line system, which can be very disturbing in many applications, because heat can be transferred from the outside, via the outer conductor 3 of the coaxial line system, to the electronic components connected to it, for example, merely through the warmth of the user's hand.

In order to avoid this, at least one additional component can be provided, according to one further development of the invention, between the mutually connected surfaces of the metallic cap nut 6 and the bearing bush 20 for the thermal decoupling of these components. If the cap nut 6 and the bearing bush 20 consist of readily conductive material, a ring made of synthetic material is arranged, for example, between the bearing cover 23 and the bearing bush 20. By preference, a corresponding synthetic-material ring is also provided for thermal decoupling on the outer periphery of the annular flange 26 of the bearing bush. Another possibility is to manufacture either the cap nut 6 and/or the bearing bush 20 themselves from a high-strength synthetic material.

FIGS. 1 and 2 show the plug-connector in a considerably enlarged scale. The coaxial line 3, 5 in the illustrated exemplary embodiment is a 1.85 mm line with an outer conductor diameter of 1.85 mm and an internal conductor diameter of only 0.804 mm.

The invention is not restricted to the exemplary embodiment illustrated. All of the features described and/or illustrated can be combined with one another as required within the framework of the invention.

The invention claimed is:

1. A coaxial plug-connector part with a cap nut, arranged in a rotatable manner on an outer conductor of a coaxial line system, the coaxial line system comprising the outer conductor in which an internal conductor is arranged in a coaxial manner, wherein the cap nut is arranged to be screw-connected to an outer thread of a counter plug-connector part, wherein at least one roller bearing is arranged between the cap nut and the outer conductor, the roller bearing cooperates with a bearing bush and is held together with this bearing bush within the cap nut by a bearing cover screw-connected to the cap nut, and an enclosed structural group comprising the roller bearing, bearing bush, and bearing cover is adapted to be fitted via a continuous internal borehole of the bearing bush onto the outer conductor of the coaxial line system.

2. The plug-connector part according to claim 1, wherein an internal thread, into which an end of the outer conductor provided with an external thread of the coaxial line system to be connected can be screwed, is formed within the continuous internal borehole of the bearing bush.

3. The plug-connector part according to claim 1, wherein the roller bearing is arranged between an end surface or an annular flange projecting radially from the bearing bush, and a corresponding end-face bearing surface at the base of the cap nut and/or of the bearing cover is screwed into the cap nut.

4. The plug-connector part according to claim 1, wherein the axial force-fit connection between the cap nut and the bearing bush is implemented via at least one axial roller bearing.

5. The plug-connector part according to claim 1, wherein structural parts made of synthetic material are arranged between mutually contacting surfaces of the cap nut and bearing bush for thermal decoupling.

6. The plug-connector part according to claim 5, wherein a synthetic-material ring is arranged between the bearing cover and the bearing bush.

7. The plug-connector part according to claim 4, wherein a synthetic material ring is arranged on an external periphery of the annular surface of the annular flange of the bearing bush.

8. The plug-connector part according to claim 5, wherein the cap nut and/or the bearing bush comprises a high-strength synthetic material.

* * * * *